United States Patent [19]

Jefferson

[11] Patent Number: 4,665,934

[45] Date of Patent: May 19, 1987

[54] FINGERNAIL GUARD

[76] Inventor: Noel E. Jefferson, 80 N. Moore St., New York, N.Y. 10013

[21] Appl. No.: 824,221

[22] Filed: Jan. 30, 1986

[51] Int. Cl.[4] ..... A45D 40/30

[52] U.S. Cl. ..... 132/88.5; D28/56

[58] Field of Search ..... 132/73, 88.5; D28/56

[56] References Cited

U.S. PATENT DOCUMENTS 2,225,571 12/1940 Smith ..... D28/56

2,323,854 7/1943 Silverman ..... D28/56

*Primary Examiner*—Robert Peshock

[57] ABSTRACT

A fingernail guard assembly characterized by a main body member which engages the finger, and a number of shield members removably engagable with the main body member. The main body member can be engaged with the finger prior to the painting of the nails, and the shield member inserted after the nails are painted to protect them as they dry. Shield members are provided in various lengths and configurations to provide a close match to the size and shape of the fingernail being protected.

5 Claims, 7 Drawing Figures

10
12
14
16
16'
18
20
22
24
26
28
30
L
L'
N
F
4
5
6

FINGERNAIL GUARD

BACKGROUND OF THE INVENTION

1. Field of the Invention

This invention relates generally to tools used during the application of cosmetics, and more particularly to fingernail guards which protect freshly painted fingernails.

2. Description of the Prior Art

It takes up to thirty minutes for freshly painted fingernails to dry. During this period, it is advisable for the woman to minimize her movements to prevent damage to the wet polish. Waiting for fingernail polish to dry can be a tedious prospect, and even if great care is taken the finish is often accidentally damaged.

To address this problem, a number of devices have been developed which protect the fingernail polish during the drying process. For example, in U.S. Pat. No. 2,225,571 of Smith, a finger attachment of unitary design is disclosed including a resilient, annular finger engaging portion, and a substantially rigid forward tapering portion which extends over a finger nail. Other fingernail protection devices of unitary design are disclosed in U.S. Pat. Nos. 2,297,807 of Somers, 2,458,709 of Kayer, 2,323,854 of Silverman, and 2,487,101 of Colby et al.

A problem with unitary fingernail guards of the prior art is that it is difficult to engage the fingernail guard with a finger without damaging the wet fingernail polish. This problem was addressed in U.S. Pat. No. 2,546,619 of Turner which teaches a U-shaped frame formed from a single strip of flexible material to which a guard member is hinged. When using Turner's device, the fingernail is painted with the guard in a vertical position, and then the guard is pivoted to a horizontal position overlying the fingernail to protect the wet fingernail polish. However, Turner sacrificed the simplicity of the unitary fingernail guards of the prior art to accomplish his purpose.

A problem not addressed in the prior art is that of fingernails of various lengths and shapes. Ideally, a fingernail guard should be just long enough to cover the fingernail to minimize the cumbersomeness of the device. With the fingernail guards of the prior art, the shield portion of the devices are of fixed length and shape, and must therefore be large enough to accommodate the largest of fingernails.

SUMMARY OF THE INVENTION

An object of this invention is to provide a fingernail guard which can be engaged with the finger prior to the application of the fingernail polish.

Another object of this invention is to provide a fingernail guard having a removable shield member which can substantially match the shape of a particular fingernail.

Briefly, the invention comprises a main body member which engages a finger near the fingernail, and a removable shield member which engages a slot in a U-shaped recess provided in the main body member. The main body member can be engaged with the finger prior to the application of the fingernail polish, and a shield member of appropriate size and length can be inserted into the slot of the main body member after the fingernail polish has been applied. Preferably, a number of shield members are provided such that their shapes can be closely matched to a particular fingernail.

An advantage of this invention is that the main body member can be engaged with the finger prior to the application of the fingernail polish. This avoids the problem of damaging the fingernail polish during the process of applying the fingernail guard.

Another advantage of this invention is that the shield member is removable. This permits the shield member to be engaged with the main body member after the nail polish has been applied and permits shield members of various shapes and sizes.

These and other objects and advantages of the present invention will no doubt become apparent upon a reading of the following descriptions and a study of the several figures of the drawing.

DETAILED DESCRIPTION OF THE PREFERRED EMBODIMENT(S)

Figures 1, 2, 3, 4, 5, 6, 7:
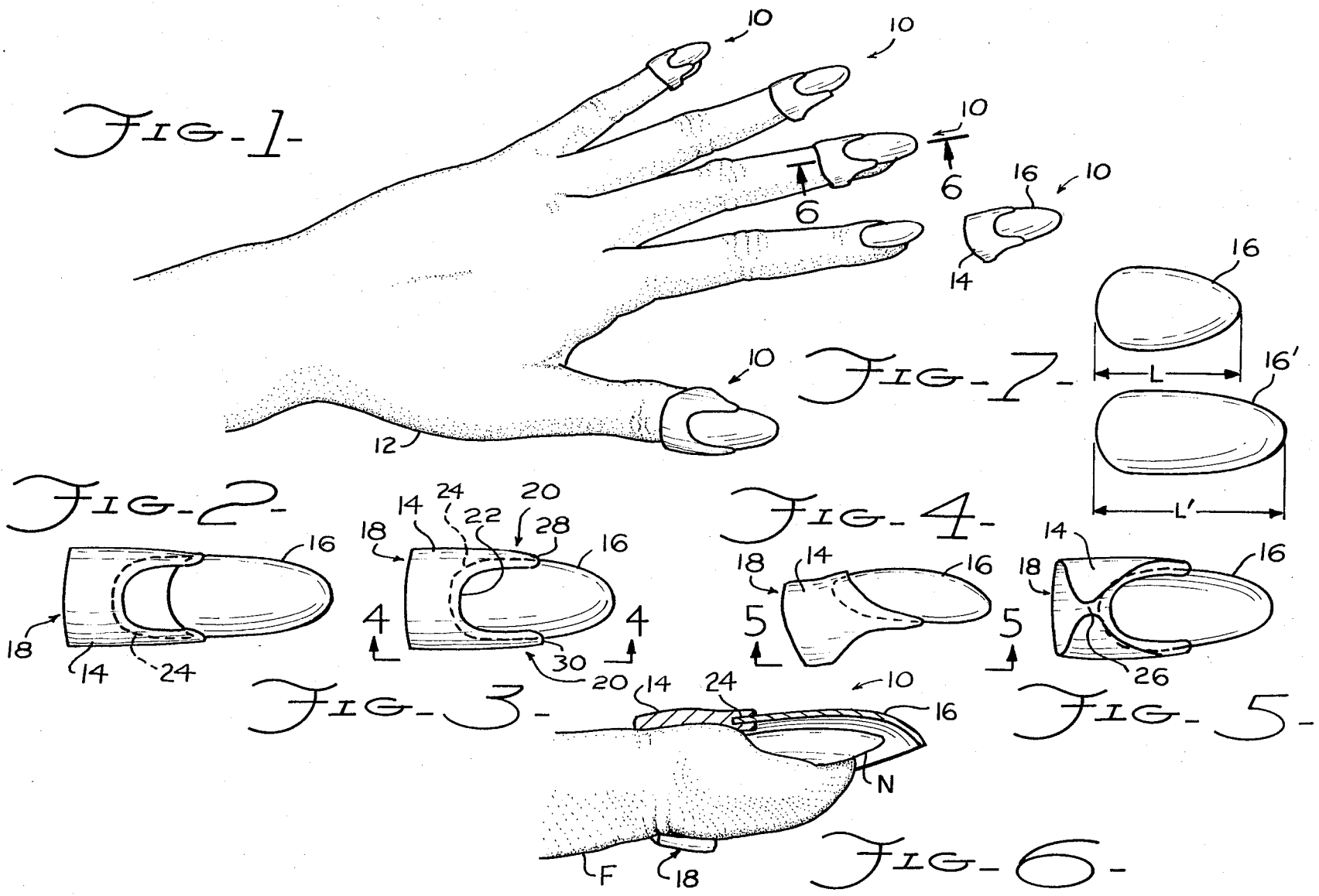
FIG. 1 is a perspective view showing a number of fingernail guard assemblies in accordance with the present invention as applied to the fingers of an hand.
FIG. 2 is a top plan view showing the shield member partially disengaged from the main body member.
FIG. 3 is a top plan view similar to the top plan view of FIG. 2, with the shield member fully engaged with the body member.
FIG. 4 is a side elevation taken along line 4—4 of FIG. 3.
FIG. 5 is a bottom plan view taken along line 5—5 of FIG. 4.
FIG. 6 is a cross section taken along line 6—6 of FIG. 1.
FIG. 7 is a top plan view of a pair of shield members of different lengths and shapes.

In FIG. 1, a number of fingernail guard assemblies 10 in accordance with the present invention are shown engaged with the fingers of a hand 12. Each of the fingernail guard assemblies 10 include a main body member 14 and a shield member 16.

Referring generally to FIGS. 2–5, main body member 14 includes a finger engaging portion 18 proximate a first end thereof, and a forwardly extending portion 20 proximate a second end thereof. The forwardly extending portion 20 is provided with a U-shaped recess 22. A peripheral slot 24 is provided in forwardly extending portion 20 to engage the edge of shield member 16. As best seen in FIG. 2, shield 16 is removably engagable with peripheral slot 24.

Finger engaging portion 18 substantially encircles the finger but is provided with an opening 26 near its lower surface. Opening 26 forms the finger engaging portion 18 into a split-ring such that the internal diameter of the finger engaging portion 18 may be varied to accommodate fingers of different sizes. Due to the U-shaped recess 22, the forward extending portion 20 forms a pair of projections 28 and 30 which follow the contour of a portion of an average fingernail.

In FIG. 6, the engagement of the fingernail guard assembly 10 with a finger F will be discussed in greater detail. Finger engaging portion 18 snugly engages finger F near the last joint of the finger. Shield member 16 (which is engaged with peripheral slot 24) is cantilevered over the nail N of the finger to fully cover the nail without touching it.

In use, the main body members 14 are engaged with the fingers such that U-shaped recesses 22 are roughly in alignment with the cuticles of the fingernails. Once the fingernails have been painted, a shield member 16 can be engaged with the peripheral slot 24 of each of the main body members 14 to cover and protect the fingernails.

Referring to FIG. 7, a first shield member 16 and a second shield member 16' are shown in top plan view. Both shields 16 and 16' are similar in configuration, that is, they are both elongated and convex in shape. However, shield member 16 is of a first length L, and shield member 16' is of a second, greater length L'. The two shield members 16 and 16' illustrate the concept that shield members can be of various lengths so as to provide a close match with the underlying fingernail. Likewise, the widths and shapes of the shield members can vary, as long as they have an end which is engagable with slot 24 of main body member 14. By providing shields of various sizes and shapes, the awkwardness of wearing the fingernail guards can be minimized while still providing protection for the fingernail polish as it dries.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A fingernail guard comprising:

a main body member adapted to engage a digit proximate a fingernail, said main body member having a finger engaging portion at a first end thereof and a forwardly extending portion provided with a U-shaped recess proximate a second end thereof; and a shield member of having a convex, oblong shape, said shield member being removably engagable said U-shaped recess of said forwardly extending portion of said main body member.

2. A fingernail guard as recited in claim 1 wherein said forwardly extending portion of said main body member is provided with a peripheral slot opening on said U-shaped recess, such that an edge portion of said shield member may be removably engaged with said peripheral slot.

3. A fingernail guard as recited in claim 2 wherein said finger engaging portion of said main body member is of a split-ring configuration, such that the diameter of said finger engaging portion may be varied.

4. A fingernail guard as recited in claim 2 wherein said shield member is adapted to be cantilevered over a fingernail when said main body member is engaged with said digit.

5. A fingernail guard as recited in claim 1 where said shield member is one of a plurality of shield members of various shapes and sizes, whereby a selected one of said plurality of shield members may be engaged with said U-shaped recess.

* * * * *